US006660917B2

(12) United States Patent
Goto et al.

(10) Patent No.: US 6,660,917 B2
(45) Date of Patent: Dec. 9, 2003

(54) KEYBOARD MUSICAL INSTRUMENT HAVING FALL BOARD FORMED WITH CLEARANCE FOR FINGERS

(75) Inventors: Motoomi Goto, Shizuoka (JP); Kiyoshi Kawamura, Shizuoka (JP)

(73) Assignee: Yamaha Corporation, Hamamatsu (JP)

( * ) Notice: Subject to any disclaimer, the term of this patent is extended or adjusted under 35 U.S.C. 154(b) by 105 days.

(21) Appl. No.: 10/099,747

(22) Filed: Mar. 14, 2002

(65) Prior Publication Data

US 2002/0134214 A1 Sep. 26, 2002

(30) Foreign Application Priority Data

Mar. 23, 2001 (JP) ..... 2001-085273

(51) Int. Cl.[7] ..... G10C 3/02
(52) U.S. Cl. ..... 84/179; 84/423 R

(58) Field of Search ..... 84/179, 423 R, 84/178, 177, 180

(56) References Cited

U.S. PATENT DOCUMENTS 4,939,969 A 7/1990 Taguchi et al.
5,487,321 A * 1/1996 Kimura et al. ..... 84/423 R
5,837,911 A * 11/1998 Inoue ..... 84/179

* cited by examiner

*Primary Examiner*—Kimberly Lockett
(74) *Attorney, Agent, or Firm*—Morrison & Foerster LLP

(57) ABSTRACT

A grand piano has a keyboard placed on a key bed, and the keyboard is covered with a fall board after completion of practice on the keyboard, wherein a recess is formed in the fall board in such a manner as to offer a clearance to fingers on the black keys so that, even if the pianist straightens his or her fingers on the land portion before moving them to other keys, the nails are never hit against the inner surface of the fall board.

19 Claims, 7 Drawing Sheets

KEYBOARD MUSICAL INSTRUMENT HAVING FALL BOARD FORMED WITH CLEARANCE FOR FINGERS

FIELD OF THE INVENTION

This invention relates to a keyboard musical instrument and, more particularly, to an acoustic piano or piano-based musical instrument having a keyboard to be covered with a fall board.

DESCRIPTION OF THE RELATED ART

A grand piano and upright piano are major models of an acoustic piano. The grand piano and upright piano each have classical contours, and the user does not want to drastically change the classical contours. FIG. 1 shows a typical example of the grand piano. The piano case 1 gives the unique contour to the grand piano. Three legs 2 downward project from the piano case 1, and keep the piano case 1 over the floor. A lyre box 3 is hung from the piano case 1 by means of lyre posts 4, and pedals 5 frontward projects from the lyre box 3.

A side board 6, an upper beam 7, a key bed 8, a desk board 9, a top board 10 and a fall board 11 are assembled into the piano case 1, and define an inner space. A keyboard 12 is placed on the key bed 8 (see FIG. 2). Though not shown in the drawings, an action mechanism, hammers and dampers are accommodated in the inner space together with strings, and the keyboard 12 is functionally connected to the action mechanism. While a pianist is playing a piece of music on the keyboard 12, the keyboard 12 causes the action mechanism selectively to give rise to free rotation of the hammers. The strings are stretched over the hammers, and are selectively struck with the hammers for generating piano tones.

The top board 10 is hinged at the left side portion thereof to the side board 6, and the inner space is open and closed depending upon the angular position of the top board 10.

The side board 6 has a contour like a wing, and arm portions 6*a* project onto both side portions of the key bed 8. The upper beam 7 laterally extends over the key bed 8, and is secured at both sides thereof to the side board 6. A slot is defined between the key bed 8 and the upper beam 7. A key slip 13 laterally extends along the front end of the key bed 8, and is secured to the key bed 8 as shown in FIG. 2. The keyboard 12 is placed on the key bed 8. The keyboard 12 is inserted into the inner space through the slot under the upper beam 7, and is functionally connected to the action mechanism (not shown). The front end of the keyboard 12 is at the back of the key slip 13, and is exposable to a pianist who sits on a stool in front of the key slip 13.

The fall board 11 laterally extends over the front portion of the key bed 8, and is rotatably connected at both ends thereof to the arm portions 6*a* of the side board 6. The fall board 11 is changed between a closed position and an open position. While the pianist is playing the piece of music on the keyboard 12, the fall board 11 is rest against the upper beam 7, and is maintained at the open position. The keyboard 12 is exposed to the pianist at the open position. When the pianist completes the practice, he or she pulls the fall board 11, and gives rise to the rotation. The fall board 11 falls onto the key slip 13 and/or key blocks. Thus, the keyboard 12 is covered with the fall board 12 at the closed position.

The keyboard 12 is fabricated from a key frame 12*a*, a front rail 12*b*, a rear frame and a back rail (not shown), balance rail (not shown), balance pins (not shown) and black and white keys 12*c*. The front rail 12*b*, balance rail and back rail are spaced from one another in the fore-and-aft direction at intervals, and are secured to the key frame 12*a*. The balance pins upwardly project from the balance rail at intervals, and the black and white keys 12*c* are put on the balance rail in such a manner as to be respectively engaged with the balance pins. The balance pins offer axes of rotation to the black and white keys 12*c*. When a pianist depresses the black/white keys 12*c*, the front portions are sunk toward the front rail 12*b*, and the action mechanism is actuated for driving the hammers for the free rotation.

The fall board 11 has a relatively thick boss portion 11*a*, relatively thin cover portion 11*b* and a beak portion 11*c*. Shafts 11*d* are embedded into the relatively thick boss portion 11*a*, and sideward project therefrom. The shafts 11*d* are rotatably supported by suitable brackets embedded in the arm portions 6*a*. The relatively thin cover portion 11*b* is merged into the relatively thick boss portion 11*a*. The relatively thin cover portion 11*b* is constant in thickness so that the inner surface 11*e* is flat as shown. The beak portion 11*c* projects from the relatively thin cover portion 11*b*, and is gently curved.

When the fall board 11 enters the closed position, the beak portion 11*c* is held in contact with the key slip 13 and/or rubber buttons on the key blocks, and keeps the cover portion 11*b* spaced from the black and white keys 12*c* as indicated by dots-and-dash line in FIG. 2. The heavy fall board 11 as well as the classical contour impresses persons as being a musical instrument of depth.

While the pianist rests the fall board 11 against the upper beam 7, the relatively thin cover portion 11*b* is upright over the keyboard 12, and the flat inner surface 11*e* is very close to the land portions 12*d* of the black keys 12*c*. When a pianist wants to generate a certain tone assigned a block key 12*c*, he or she depresses the land portion 12*d* of the black key 12*c*. The pianist bends a finger, and presses the tip of the finger against the land portion 12*d* as indicated by dots-and-dash line. When the pianist changes the finger from the black key 12*c* to another key 12*c*, he or she sometimes straightens the finger as indicated by real line, and, thereafter, moves the finger to another key 12*c*.

A problem is encountered in that the pianist tends to hit the nail against the inner surface 11*e*. If the nail is frequently hit against the inner surface 11*e*, the nail is cracked and broken into two pieces. The fall board 11 is also damaged. When the pianist hits the nails against the inner surface 11*e*, the inner surface is scratched, and the smoothly finished surface becomes disfigured with the scratches.

SUMMARY OF THE INVENTION

It is therefore an important object of the present invention to provide a piano-like musical instrument, a fall board of which allows a player to finger on the keyboard without hitting nails thereagainst.

To accomplish the object, the present invention proposes to form a clearance for allowing a pianist to straighten his or her fingers.

In accordance with one aspect of the present invention, there is provided a keyboard musical instrument comprising a case having a side wall and a bottom plate fixed to the side plate in such a manner as to be located between both side portions of the side wall, a mechanism accommodated in the case, a keyboard placed on the bottom plate so as to be exposed to a space between the side portions and selectively moved for actuating the mechanism, and a fall board rotatably connected to the case so that a user changes the fall board between an open position for standing over the keyboard and a closed position for covering the keyboard therewith and formed with a recess extending along the keyboard so as to offer a clearance to fingers on keys of the keyboard at the open position.

BRIEF DESCRIPTION OF THE DRAWINGS

The features and advantages of the piano-based musical instrument will be more clearly understood from the following description taken in conjunction with the accompanying drawings, in which.

DESCRIPTION OF THE PREFERRED EMBODIMENTS

First Embodiment

Figure 1:
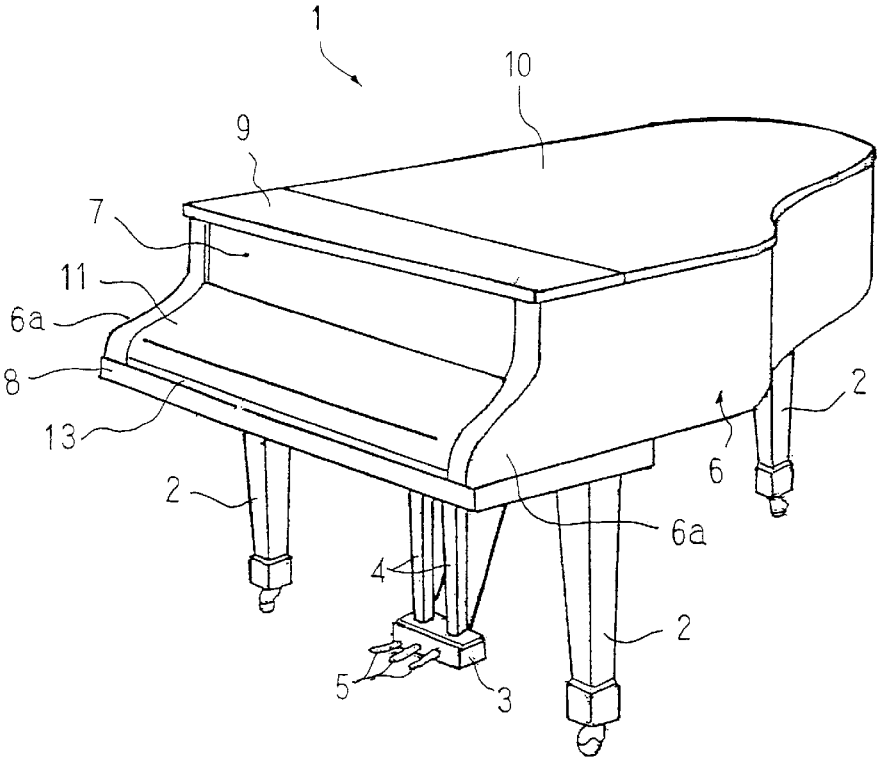
Fig. 1 PRIOR ART
FIG. 1 is a perspective view showing the contour of the grand piano.
Figure 2:
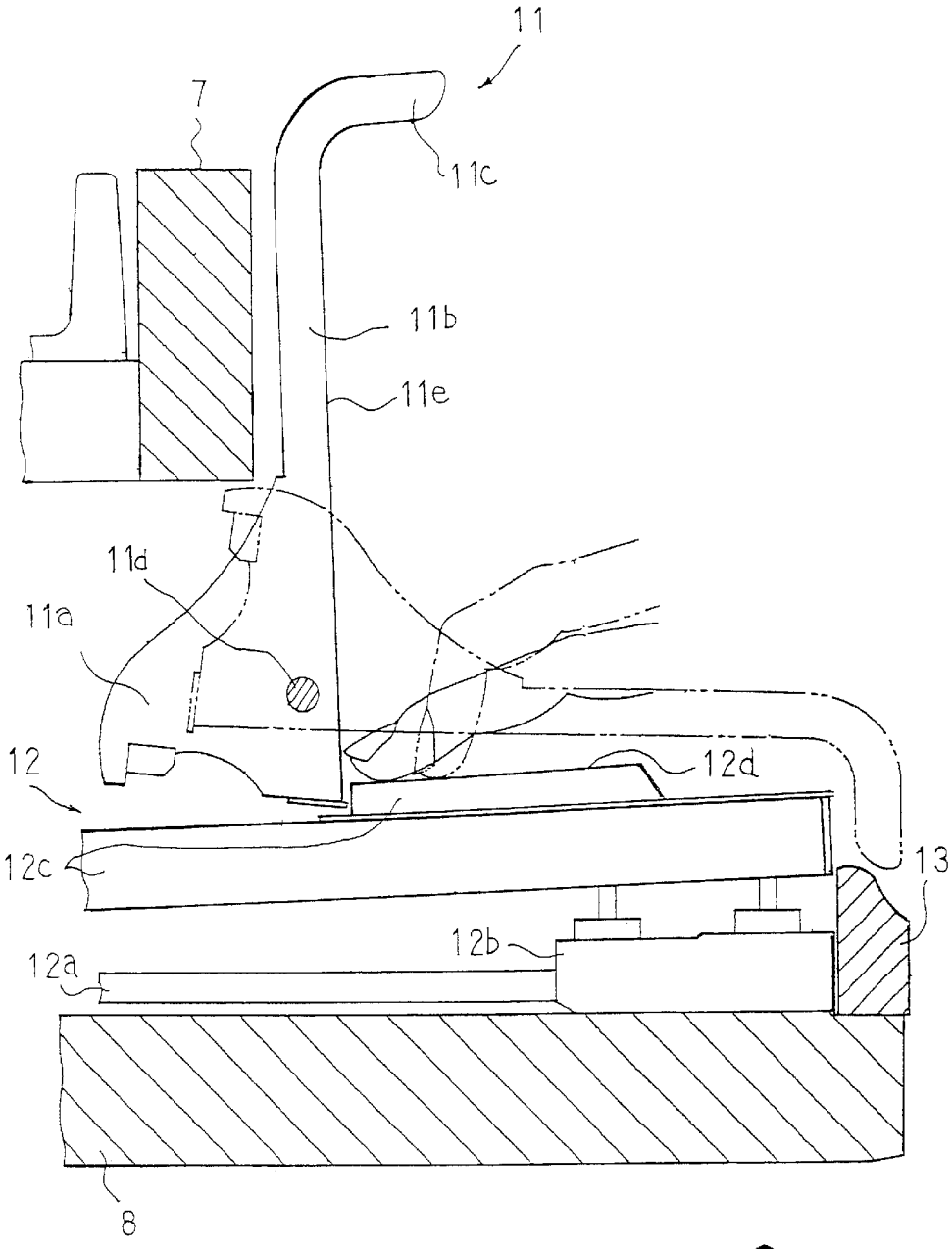
Fig. 2 PRIOR ART
FIG. 2 is a cross sectional view showing the fall board incorporated in the prior art grand piano.
Figure 3:
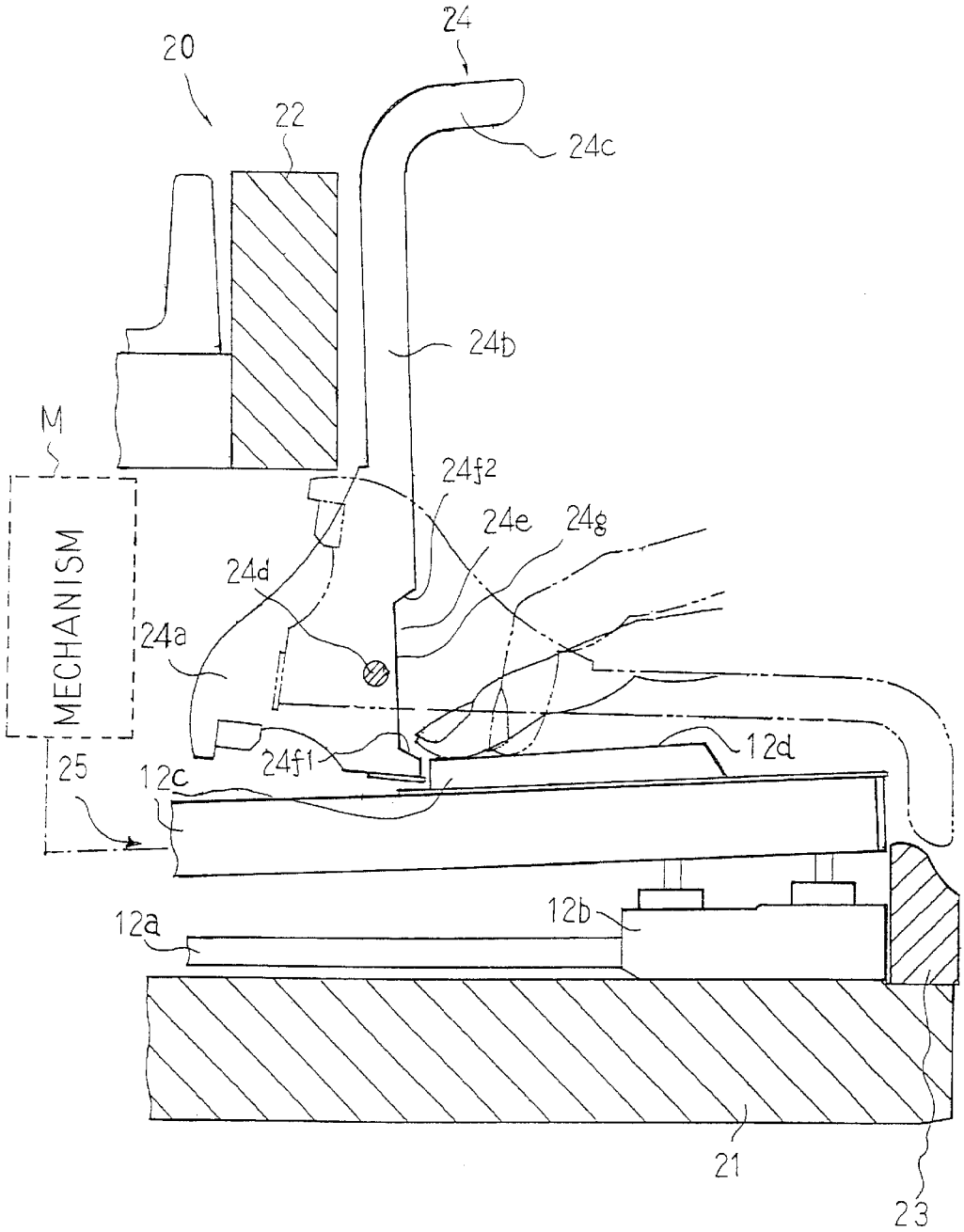
FIG. 3 is a cross sectional view showing a fall board incorporated in a grand piano according to the present invention.

A grand piano embodying the present invention has a contour as similar to that of the grand piano shown in FIG. 1. According, the grand piano has a piano case 20, which is also fabricated from a side board, key bed 21, upper beam 22, key slip 23, a fall board 24 and other component members as similar to the piano case 1 of the prior art grand piano. A keyboard 25 is mounted on the key bed 21 at the back of the key slip 23, and partially inserted into the inner space of the piano case 20 through the slot between the arm portions of the side board under the upper beam 22. Though now shown in the drawings, an action mechanism, hammers, dampers and strings are accommodated in the inner space of the piano case 20, and the keyboard 25 is linked with the action mechanism so as selectively to drive the hammers for free rotation. The strings are struck with the associated hammers at the end of the free rotation. Thus, the grand piano implementing the first embodiment is same in contour as the prior art grand piano, and the same mechanism is incorporated in the piano case 20. A mechanism M stands for the action mechanism, hammers, dampers and strings.

The keyboard 25 is similar in structure to the keyboard 12, and black and white keys and other component parts of the keyboard 25 are labeled with references designating corresponding parts of the prior art keyboard 12 without detailed description for the sake of simplicity.

The fall board 24 has a relatively thick boss portion 24*a*, relatively thin cover portion 24*b* and a beak portion 24*c*. Shafts 24*d* are embedded into the relatively thick boss portion 24*a*, and sideward project therefrom. The shafts 24*d* are rotatably supported by suitable brackets embedded in the arm portions of the side board. The relatively thin cover portion 24*b* is merged into the relatively thick boss portion 24*a*. The relatively thin cover portion 24*b* is substantially constant in thickness, and the beak portion 24*c* projects from the relatively thin cover portion 24*b*. The relatively thin cover portion 24*b* may be slightly curved. The beak portion 24*c* is gently curved, and keeps the relatively thin portion 24*b* spaced from the keyboard 25 at the closed position.

Figure 4:
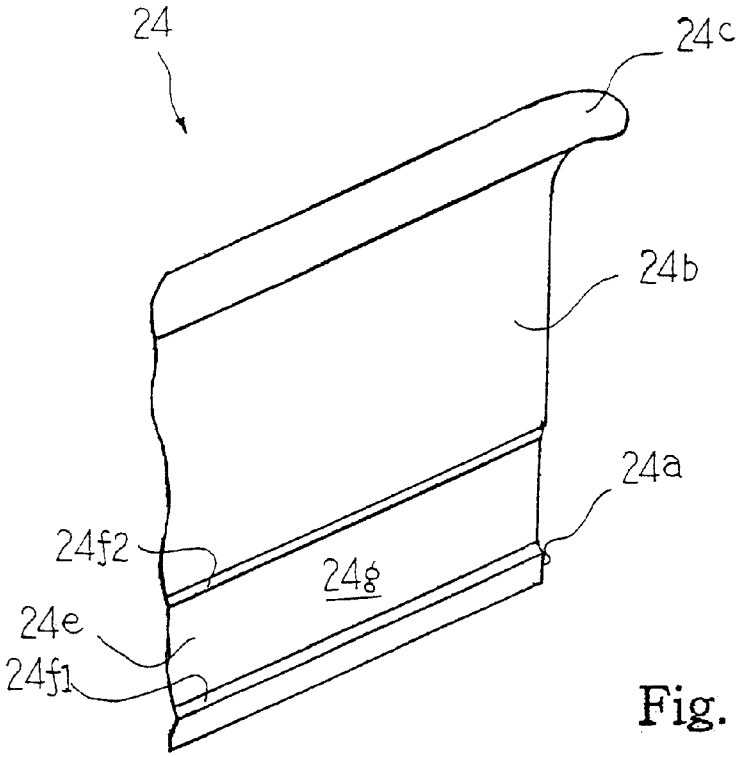
FIG. 4 is a perspective view showing a recess formed in the fall board.

A recess 24*e* is formed in the relatively thick boss portion 24*a*. The recess 24*e* is several millimeters deep to several centimeters deep, and laterally extends as shown in FIG. 4. The recess 24*e* is open at both side surface of the relatively thick boss portion 24*a*. Thus, the recess 24*e* is defined by two side surfaces 24*f*1/24*f*2 and a bottom surface 24*g* between the side surfaces 24*f*1 and 24*f*2. The side surfaces 24*f*1/24*f*2 are continuous to the inner surface, and a periphery is defined between the inner surface and the side surfaces 24*f*1/24*f*2. When the fall board 24 is changed to the open position, the bottom surface 24*g* is directed to the pianist, and the periphery is on a level with the upper surface of the land portions 12*d* of the black keys 12*c*. Otherwise, the periphery may be lower than the upper surfaces of the land portions 12*d* of the black keys 12*c*. Thus, the recess 24*e* offers a clearance to the fingers on the land portions 12*d*. Even when the pianist straightens the fingers on the land portions 12*d*, the bottom surface 24*g* is still spaced from the nails, and is never scratched.

The shafts 24*d* are embedded in the relatively thick boss portion 24*a*, and the remaining portion between the shafts 24*d* and the bottom surface 24*g* is thin. If the remaining portion is too thin, the shafts 24*g* would be spaced from the bottom surface 24*g*. Although the heavy fall board 24 is formed with the recess 24*e*, the recess 24*e* is only exposed to the inner surface of the fall board 24. When the pianist falls the fall board 24 onto the key slip 23, the grand piano has the classical contour, and nobody feels the grand piano curious.

As will be understood from the foregoing description, the recess 24*e* offers the clearance to the pianist, and permits the pianist to straighten his or her fingers on the land portions of the black keys 12*c* after release of the black keys 12*c*. While the pianist is fingering a piece of music on the keyboard 25, he or she never hits his or her fingers against the fall board 24, and smoothly moves the fingers over the keyboard 25. The nails do not reach the bottom surface 24*g*. The nails are neither broken, nor scratches the inner surface of the fall board 24. Thus, the recess 24*e* is effective against the trouble due to the fall board 24 close to the array of the land portions 12*d*.

Second Embodiment

Figure 5:
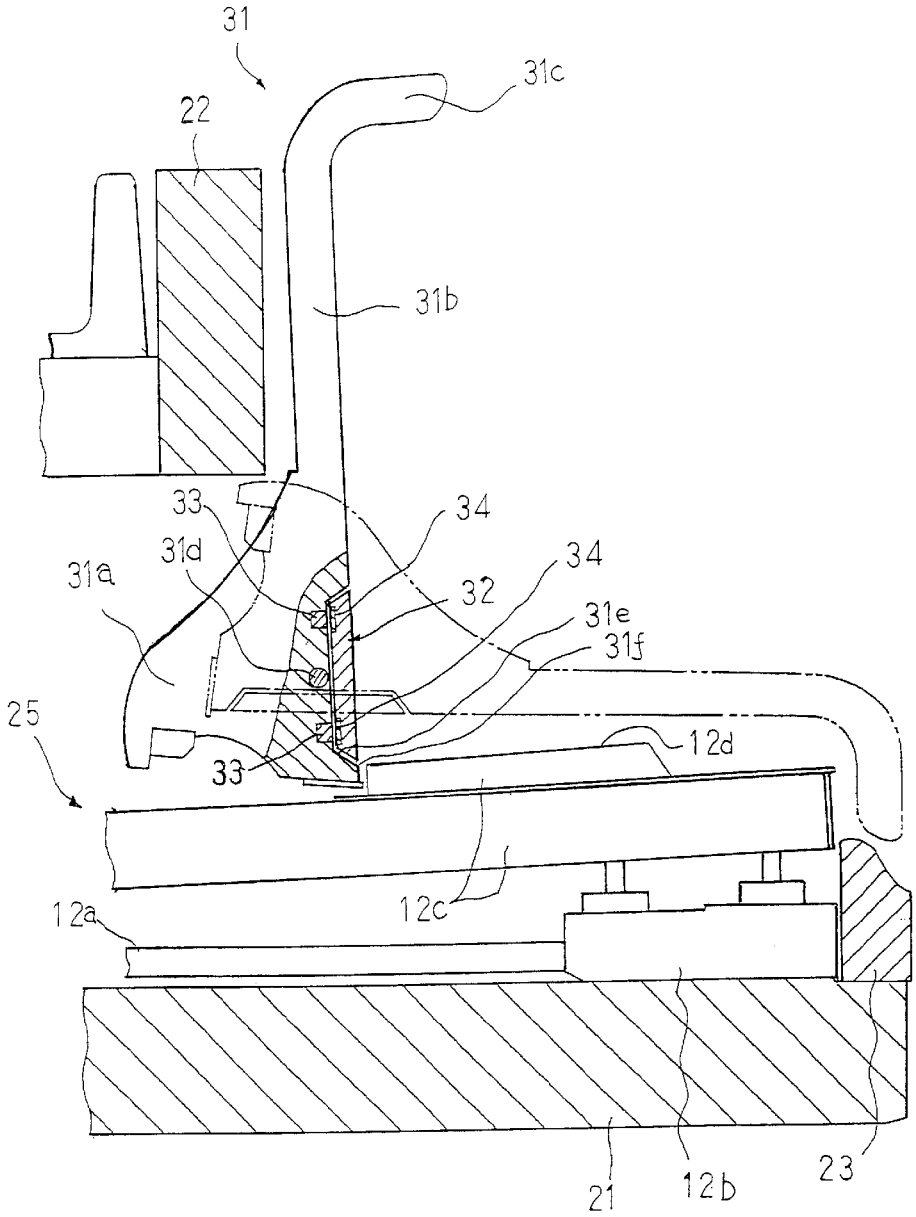
FIG. 5 is a cross sectional view showing a fall board incorporated in another grand piano according to the present invention.

Turning to FIG. 5 of the drawings, a fall board 31 is incorporated in yet another grand piano embodying the present invention. The grand piano implementing the second embodiment is similar in structure to that of the first embodiment, and, for this reason, other parts are labeled with same references designating corresponding parts of the grand piano implementing the first embodiment without detailed description.

The fall board 31 has a relatively thick boss portion 31*a*, relatively thin cover portion 31*b* and a beak portion 31*c*. Shafts 31*d* are embedded in the relatively thick boss portion 31*a*, and sideward project therefrom. The shafts 31*d* are rotatably supported by suitable brackets embedded in the arm portions of the side board. The relatively thin cover portion 31*b* is merged into the relatively thick boss portion 31*a*. The relatively thin cover portion 31*b* is substantially constant in thickness, and the beak portion 31*c* projects from the relatively thin cover portion 31*b*. The beak portion 31*c* is gently curved, and keeps the relatively thin portion 31*b* spaced from the keyboard 25 at the closed position.

A recess 31*e* is formed in the relatively thick boss portion 31*a*. The recess 31*e* is several millimeters deep to several centimeters deep, and laterally extends as similar to the recess 24*e*. The recess 31*e* is defined by two side surfaces and a bottom surface. When the fall board 31 is changed to the open position, the periphery 31*f* of the recess 31*e* is on a level with the upper surface of the land portions 12*d* at the rest positions. Otherwise, the periphery 31*f* may be lower than the upper surfaces of the land portions 12*d*. Thus, the recess 31*e* offers a clearance to the fingers of the pianist.

A filler 32 is provided for the recess 31*e*. The filler 32 has the same configuration as the recess 31*e*. Pieces of permanent magnet 33 and other pieces of magnetic substance 34 are embedded in the relatively thick boss portion 31*a* and the filler 32, and are exposed to the bottom surface of the recess 31*e* and the lower surface of the filler 32, respectively. When the filler 32 is put in the recess 31*e*, the pieces of magnetic substance 34 are attracted to the pieces of permanent magnet 33, and keep the filler 32 in the recess 31*e*. However, the pieces of permanent magnet 33 are not so strong that a pianist can remove the filler 32 from the recess 31*e*.

The filler 32 is finished as similar to the fall board 31, and makes the fall board 31 as if any recess 31*e* is not formed therein. When a pianist wants to practice the fingering on the keyboard 25, he or she removes the filler 32 from the recess 31*e*. Then, the recess 31*e* is open, and offers the clearance to the fingers on the land portions 12*d*.

The grand piano implementing the second embodiment achieves all the advantages of the first embodiment. Moreover, the filler 32 improves the appearance of the grand piano.

Third Embodiment

Figure 6:
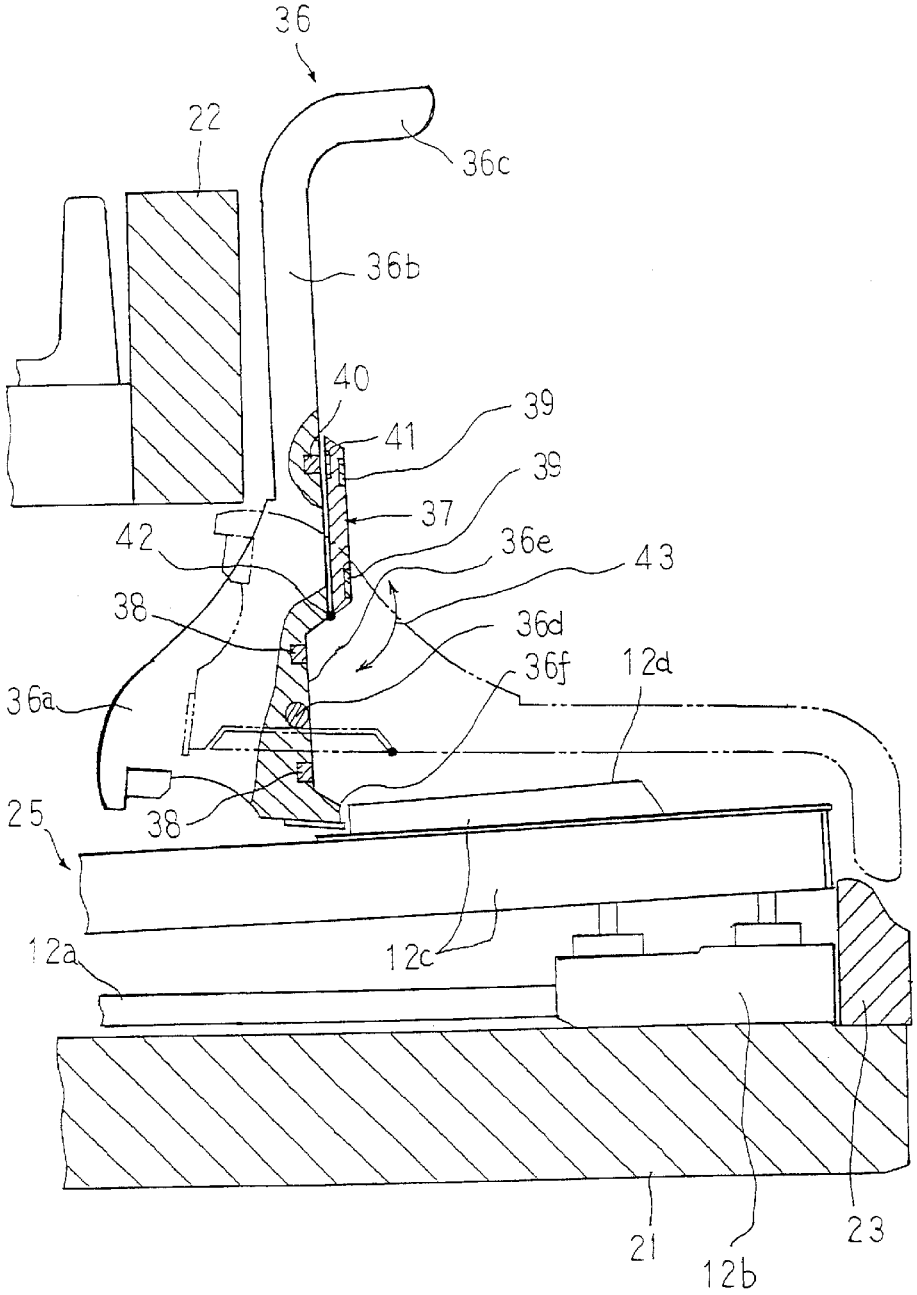
FIG. 6 is a cross sectional view showing a fall board incorporated in yet another grand piano according to the present invention.

FIG. 6 shows yet another fall board 36 incorporated in yet another grand piano embodying the present invention. The grand piano implementing the third embodiment is similar in structure to that of the first embodiment, and, for this reason, other parts are labeled with same references designating corresponding parts of the grand piano implementing the first embodiment without detailed description.

The fall board 36 has a relatively thick boss portion 36*a*, relatively thin cover portion 36*b* and a beak portion 36*c*. Shafts 36*d* are embedded in the relatively thick boss portion 36*a*, and sideward project therefrom. The shafts 36*d* are rotatably supported by suitable brackets embedded in the arm portions of the side board. The relatively thin cover portion 36*b* is merged into the relatively thick boss portion 36*a*. The relatively thin cover portion 36*b* is substantially constant in thickness, and the beak portion 36*c* projects from the relatively thin cover portion 36*b*. The beak portion 36*c* is gently curved, and keeps the relatively thin portion 36*b* spaced from the keyboard 25 at the closed position as indicated by dots-and-dash line.

A recess 36*e* is formed in the relatively thick boss portion 36*a*. The recess 36*e* is several millimeters deep, and laterally extends as similar to the recess 24*e*. The recess 36*e* is defined by two side surfaces and a bottom surface.

When the fall board 36 is changed to the open position, the periphery 36*f* of the recess 36*e* is on a level with the upper surface of the land portions 12*d* at the rest positions. Otherwise, the periphery 36*f* may be lower than the upper surfaces of the land portions 12*d*. Thus, the recess 36*e* offers a clearance to the fingers of the pianist.

A filler 37 is provided for the recess 36*e*. The filler 37 has the same configuration as the recess 36*e*. Pieces of permanent magnet 38 and other pieces of magnetic substance 39 are embedded in the relatively thick boss portion 31*a* and the filler 37, and are exposed to the bottom surface of the recess 36*e* and the lower surface of the filler 37. Pieces of permanent magnet 40 are further embedded in the relatively thin cover portion 36*b*, and corresponding pieces of magnetic substance 41 are further embedded in the filler 37. The pieces of permanent magnet 39 are exposed to the inner surface of the relatively thin cover portion 36*b*, and the pieces of magnetic substance 40 are exposed to the upper surface, which is reverse to the lower surface. The filler 37 is connected at one end thereof to the relatively thin cover portion 36*b* by means of a hinge 42, and, accordingly, the filler 37 is rotatable about the hinge 42 as indicated by arrow 43.

The pieces of permanent magnet 38, pieces of magnetic substance 39, pieces of permanent magnet 40 and pieces of magnetic substance 41 are arranged in such a manner that the pieces of magnetic substance 39 or pieces of magnetic substance 41 are held in contact with the associated pieces of permanent magnet 38 or pieces of permanent magnet 40. When a pianist wishes to practice fingering on the keyboard 25, he or she turns the filler 37 about the hinge 42, and moves it onto the relatively thin cover portion 36*b*. Then, the pieces of magnetic substance 41 are attracted to contact with the pieces of permanent magnet 40, and keeps the filler 37 on the relatively thin cover portion 36*b*. Then, the recess 36*e* is opened, and offers the clearance to the fingers on the land portions 12*d*.

When the pianist completes the practice, he or she oppositely turns the filler 37 about the hinge 42, and moves it into the recess 36*e*. The pieces of magnetic substance 39 are attracted to the pieces of permanent substance 38, and the filler 37 is maintained in the recess 36*e*. The filler 37 is finished as similar to the fall board 36, and makes the fall board 36 as if any recess is not formed therein.

The grand piano implementing the third embodiment achieves all the advantages of the first and second embodiments. Moreover, the pieces of permanent magnet 40 and pieces of magnetic substance 41 keep the filler 32 on the relatively thin cover portion 36*b* so as to enhance the manipulability.

As will be appreciated from the foregoing description, the fall board 24/31/36 according to the present invention is formed with the recess 24*e*/31*e*/36*e* so as to offer a clearance to the fingers on the land portions 12*d*. The pianist does not break the nails, and the fall board 24/31/36 is never damaged with scratches. Moreover, the filler 32/37 keeps the fall board 24/31/36 in the good looking.

Although particular embodiments of the present invention have been shown and described, it will be apparent to those skilled in the art that various changes and modifications may be made without departing from the spirit and scope of the present invention.

Figure 7:
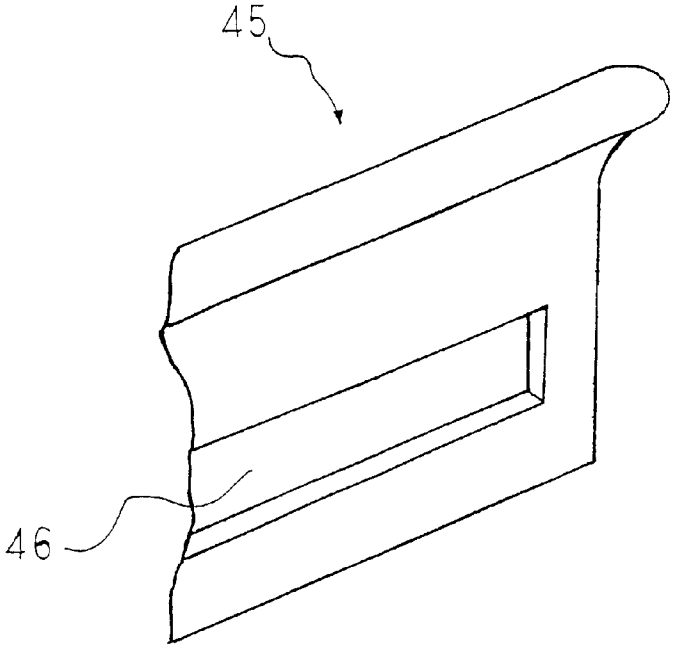
FIG. 7 is a perspective view showing another fall board employable in the grand piano according to the present invention.

For example, a fall board 45 may be formed with a recess 46 not exposed to the side surfaces thereof as shown in FIG. 7. Key blocks are usually provided between the array of black/white keys and the side board, and the array of black/white keys does not reach the arm portions of the side board. A pianist merely moves his or her fingers over the array of black/white keys, and never moves them onto the key blocks. In other words, the clearance is required for the fingers on the land portions of the black keys. Accordingly, the recess 46 is as wide as the array of black/white keys, and does not extend into the side portions to be opposed to the key blocks.

The pieces of permanent magnet 33 and pieces of magnetic substance 34 may be replaced with another kind of fastening means. Another kind of fastening means may be small projections and small recesses to snugly receive the small projections. A hook-and-loop fastener may be used as yet another fastening means.

A fall board may be rotatably connected to another board different from the side board. Rotary damper units may be provided between the fall board and the arm portions so as to make the fall board gently brought into contact with the key slip.

Fall boards according to the present invention are useful to other kinds of keyboard musical instrument in so far as the pianist feels the fall board obstacle against the fingering. Other kinds of keyboard musical instrument are, by way of example, an upright piano and piano-based musical instrument such as, for example, a silent piano, automatic player piano, electric piano and keyboard for practical use.

Figure 8:
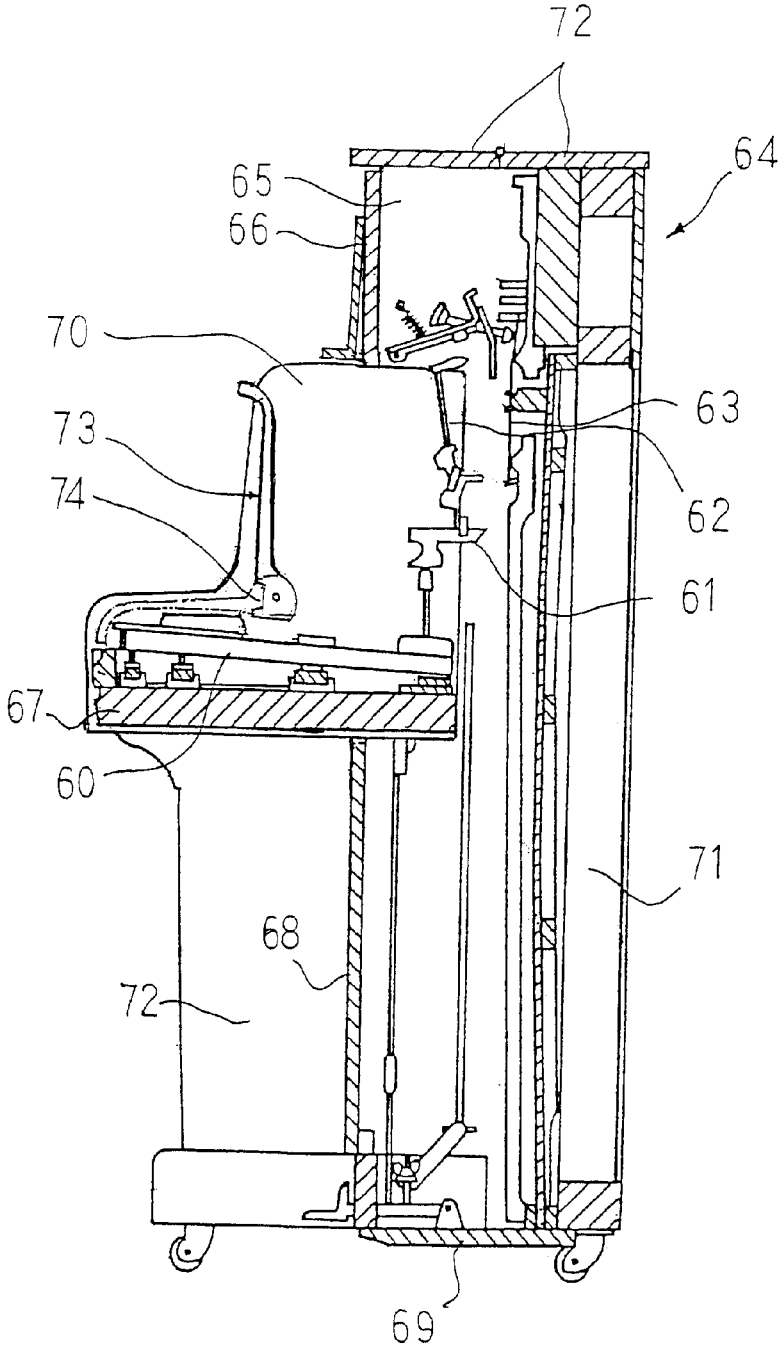
FIG. 8 is a cross sectional side view showing the structure of an upright piano according to the present invention.

FIG. 8 shows an example of the upright piano to which the present invention appertains. The upright piano is fabricated from well-known components such as a keyboard 60, an action mechanism 61, hammers 62, strings 63 and so forth. The keyboard 60 is exposed to a pianist, and the action mechanism 61, hammers 62 and the strings 63 are accommodated in a piano case 64. A pair of side boards 65, an upper front board 66, a key bed 67, a lower front board 68, a bottom board 69, a pair of side arms 70, a back post assembly 71 and a pair of leg posts 72 are assembled into the piano case 64. The side boards 65 are laterally spaced from each other, and leg posts 72 frontward project from the lower portions of the side board 65, respectively. The upper front board 66 and the lower front board 68 laterally extend between the side boards 65, and defines the front surface of the piano case 64. The back post assembly 71 also laterally extends between the side boards 65, and defines the back surface of the piano case 64. The key bed 67 is fixed to the upper surfaces of the leg posts 72, and frontward projects from the side boards 65. The keyboard 60 is placed on the key bed 67, and the side arms 70 frontward project from the side boards 65 on both sides of the keyboard 60. The bottom board 69 laterally extends between the side boards 65, and defines the bottom surface of the piano case 64. Thus, the side boards 65, leg posts 72, key bed 67, upper front board 66, lower front board 68, bottom board 69, side arms 70 and the back post assembly 71 define the space where the action mechanism 61, hammers 62, strings 63 and other components are accommodated.

The piano case 64 further includes a top board 72 and a fall board 73. The top board 72 is implemented by two boards. One of the two boards is fixed to the back post assembly 71, and the other board is hinged to it. Thus, the board is folded back onto the other board. The fall board 73 is rotatably connected at both sides thereof to the side arms 70. The fall board 73 changes the attitude depending upon the angular position thereof. When the fall board 73 is rotated in the clockwise direction, the fall board 73 rises over the keyboard 60, and permits a pianist to finger on the keyboard 60. On the other hand, when the fall board 73 is fallen onto the side arms, the keyboard 60 is covered with the fall board 73.

A recess 74 is formed in the fall board 73. The recess 74 is several millimeters deep to several centimeters deep, and laterally extends so as to be as long as the keyboard 60. While a pianist is playing a piece of music on the keyboard 60, he or she sometimes stretch his or her fingers on the black keys. The recess 74 offers a clearance to the pianist, and the fingers do not scratch the fall board 73.

The silent piano is a combination of an acoustic piano, i.e., a grand piano or upright piano and an electronic tone generating system, and a pianist can play a piece of music in acoustic tones or electronic tones. In order to permit the pianist to play a piece of music in the electronic tones, the silent piano is equipped with a hammer stopper and an electronic sound generating system. The hammer stopper is provided in association with the hammers, and is changed between a free position and a blocking position. While the hammer stopper is maintained at the free position, the hammers strike the associated sets of strings without any interruption by the hammer stopper. When the hammer stopper is changed to the blocking position, the hammer stopper enters into the trajectories of the hammers, and the hammers rebound on the hammer stopper before striking the strings. The electronic sound generating system produces electronic sounds instead of the piano tones so that user can practice the fingering without disturbance to the neighborhood.

The automatic player piano is a combination of an acoustic piano and an automatic playing system. The acoustic piano is either grand or upright. The automatic playing system includes solenoid-operated key actuators installed under the keyboard and a controller. When a set of music data codes is supplied to the controller, the controller analyzes the set of music data codes, and selects the keys to be moved from the keyboard and times at which the keys start the motion. When the time comes, the controller supplies a driving signal to the solenoid-operated key actuator under the key to be moved. The solenoid-operated key actuator moves the key at the give time, and the key actuates the action unit so as to give rise to free rotation of the hammer toward the string. In this instance, the automatic playing system is further incorporated in the mechanism.

The keyboard for practical use is a modification of the acoustic piano. The hammer assemblies and strings are replaced with beaters and an impact absorber. While a trainee is fingering a piece of music on the keyboard the depressed keys actuate the associated action units, which in turn give rise to free rotation of the hammers through the escape. The beaters rebound on the impact absorber, and the piano tones are not generated. An electronic tone generating system may be further incorporated in the keyboard for practical use. In this instance, sensors monitor the beaters, and periodically report the current positions of the beaters. The controller analyzes the series of positional data information so as to specify the depressed keys. The controller produces music data codes representative of the fingering on the keyboard, and supplies them to a tone generator. The tone generator produces an audio signal from the music data codes, and a sound system converts the audio signal to the electronic tones. Thus, the trainee checks the fingering for his training through the electronic tones. In this instance, the action units, hammers and impact absorbers as a whole constitute a mechanism.

What is claimed is:

1. A keyboard musical instrument comprising:

a case having a side wall and a bottom plate fixed to said side plate in such a manner as to be located between both side portions of said side wall;

a mechanism accommodated in said case;

a keyboard placed on said bottom plate so as to be exposed to a space between said side portions, and selectively moved for actuating said mechanism; and a fall board rotatably connected to said case so that a user changes said fall board between an open position for standing over said keyboard and a closed position for covering said keyboard therewith, and formed with a recess extending along said keyboard so as to offer a clearance to fingers on said keyboard at said open position.

2. The keyboard musical instrument as set forth in claim 1, in which said keyboard includes black keys and white keys laid on a pattern identical with that of an acoustic piano, and said fall board stands close to land portions of said black keys at said open position.

3. The keyboard musical instrument as set forth in claim 2, in which said case, said keyboard and said fall board impress persons as a grand piano.

4. The keyboard musical instrument as set forth in claim 3, in which said keyboard is linked with said mechanism for selectively generating piano tones.

5. The keyboard musical instrument as set forth in claim 2, in which said fall board is rotatably connected at both end thereof to said side portions spaced by a distance greater than a width of said keyboard on said bottom plate.

6. The keyboard musical instrument as set forth in claim 5, in which said recess is open to both side surfaces of said fall board.

7. The keyboard musical instrument as set forth in claim 5, in which said recess has a width less than said distance, and is aligned with said keyboard.

8. The keyboard musical instrument as set forth in claim 5, in which said recess is as wide as said keyboard, and is aligned with said keyboard.

9. The keyboard musical instrument as set forth in claim 5, in which said case, said keyboard and said fall board impress persons as a grand piano.

10. The keyboard musical instrument as set forth in claim 2, further comprising a filler received in and removed from said recess and having a configuration corresponding to said recess for providing a surface substantially coplanar with an inner surface of said fall board, and a fastener provided between said fall board and said filler for keeping said filler in said recess.

11. The keyboard musical instrument as set forth in claim 10, in which said fastener includes first pieces embedded in said fall board and exposed to a bottom of said recess and second pieces embedded to said filler and exposed to another surface reverse to said surface so as to be magnetically attracted to said first pieces.

12. The keyboard musical instrument as set forth in claim 10, further comprising a hinge connected between said fall board and said filler and another fastener provided between said fall board and said filler for keeping said filler on said fall board.

13. The keyboard as set forth in claim 12, in which said fastener includes first pieces embedded in said fall board and exposed to a bottom of said recess and second pieces embedded to said filler and exposed to another surface reverse to said surface in such a manner as to be magnetically attracted to said first pieces, and said another fastener includes third pieces embedded in said fall board and exposed to said inner surface and fourth pieces embedded in said filler and exposed to said surface in such a manner as to be magnetically attracted to said third pieces.

14. The keyboard musical instrument as set forth in claim 10, in which said fall board has another surface reverse to said surface, and said another surface, an entire outer surface of said case and said keyboard impress persons as a grand piano.

15. A grand piano comprising:

a piano case defining an inner space, and including a side board, a key bed fixed to said side board and located between arm portions of said side board and an upper beam extending over a rear surface of said key bed and fixed to said side board;

a mechanism accommodated in said inner space;

a keyboard placed on a front surface of said key bed between said arm portions, and including black keys and white keys laid on a certain pattern and linked with said mechanism for selectively generating piano tones; and a fall board rotatably connected at both ends thereof to said arm portions so as to be changed between an open position for standing against said upper beam and a closed position for covering said keyboard, and formed with a recess extending along said keyboard and offering a clearance to fingers on said black keys.

16. The grand piano as set forth in claim 15, further comprising a filler received in and removed from said recess and having a configuration corresponding to said recess for providing a surface substantially coplanar with an inner surface of said fall board, and a fastener provided between said fall board and said filler for keeping said filler in said recess.

17. The keyboard musical instrument as set forth in claim 16, in which said fastener includes first pieces embedded in said fall board and exposed to a bottom of said recess and second pieces embedded to said filler and exposed to another surface reverse to said surface so as to be magnetically attracted to said first pieces.

18. The keyboard musical instrument as set forth in claim 16, further comprising a hinge connected between said fall board and said filler and another fastener provided between said fall board and said filler for keeping said filler on said fall board.

19. The keyboard as set forth in claim 18, in which said fastener includes first pieces embedded in said fall board and exposed to a bottom of said recess and second pieces embedded to said filler and exposed to another surface reverse to said surface in such a manner as to be magnetically attracted to said first pieces, and said another fastener includes third pieces embedded in said fall board and exposed to said inner surface and fourth pieces embedded in said filler and exposed to said surface in such a manner as to be magnetically attracted to said third pieces.

* * * * *